US006100458A

United States Patent [19]

Carrington et al.

[11] Patent Number: 6,100,458

[45] Date of Patent: Aug. 8, 2000

[54] NECK FOR STRINGED INSTRUMENT

[75] Inventors: Martin W. Carrington; Douglas J. Baxendell, both of San Diego, Calif.; André Terzaghi, Warkworth, New Zealand

[73] Assignee: Horizon Sports Technologies, Inc., San Diego, Calif.

[21] Appl. No.: 09/275,162

[22] Filed: Mar. 24, 1999

[51] Int. Cl.[7] ..... G10D 3/00

[52] U.S. Cl. ..... 84/293; 84/267

[58] Field of Search ..... 84/293, 291, 267, 84/314 R

[56] References Cited

U.S. PATENT DOCUMENTS

| | | | |
|---|---|---|---|
| 4,950,437 | 8/1990 | Lieber | 264/257 |
| 5,691,491 | 11/1997 | DeGomez | 84/291 |
| 5,895,872 | 4/1999 | Chase | 84/291 |

*Primary Examiner*—Bentsu Ro
*Assistant Examiner*—Shih-yung Hsieh
*Attorney, Agent, or Firm*—Nydegger & Associates

[57] ABSTRACT

A neck for a stringed musical instrument includes a foam core formed with a peghead and layers of reinforcing material positioned over the foam core. A surfacing material is bonded to the layers of reinforcing material and to the foam core to establish an external surface for the neck. The musical instrument includes a body attached to the neck and a truss rod assembly that is embedded in the foam core is adjustable to move the peghead relative to the body for tuning purposes. In manufacture, the foam core is molded in a primary mold. The layers of reinforcing material are then positioned over the foam core to create a preform assembly. Next, a surfacing material is shaped by the cavity surface of a secondary mold and the preform assembly is placed in the secondary mold. When the secondary mold is closed, a vacuum is drawn in its cavity and resin is injected into the cavity to bond the preform assembly to the surfacing material for manufacture of the neck.

16 Claims, 2 Drawing Sheets

NECK FOR STRINGED INSTRUMENT

FIELD OF THE INVENTION

The present invention pertains generally to stringed instruments. More particularly, the present invention pertains to the structure of a stringed instrument and to methods for manufacturing such structure. The present invention is particularly, but not exclusively, useful as a method for manufacturing the neck of a stringed instrument as an integrally unified structure.

BACKGROUND OF THE INVENTION

Most stringed instruments, such as the violin, cello, guitar or banjo, include a body portion, a neck and a peghead. They also, of course, have strings which are stretched across the body and along the neck between a bridge on the body and the peghead. Importantly, in order for the instrument to be tuned, the strings must be placed in a proper state of tension. Moreover, it is necessary that the instrument remain tuned while it is being played.

Structurally, the neck of a stringed instrument is important for both mechanical and acoustic reasons. In more detail, these reasons include: strength, stability, resonance, and weight and balance. Strength of the neck is important so that the tension that is required to keep the instrument in tune can be sustained for relatively long periods of time. Stability of the neck is important in order to minimize or effectively eliminate the adverse effects of external factors such as temperature and humidity. Not surprisingly, some resonance in the neck is required to augment the instruments ability to amplify and radiate sound. Additionally, weight and balance considerations for the neck are important insofar as these considerations give the musician a "feel" and an "affinity" for the instrument.

For the construction of early stringed instruments, great reliance was placed on obtaining the proper materials. Specifically, this meant selecting the appropriate hardwoods that would provide the proper qualities of resonance and tonality for the instrument. The appropriate hardwoods are, however, difficult to come by. Thus, in more recent years, with the development of improved materials, synthetic materials have been used for the manufacturing of stringed instruments with varying degrees of acceptability. For example, U.S. Pat. No. 4,313,362 which issued to Lieber for an invention entitled "Guitar Construction" discloses a guitar which has a plastic shell into which foam is shot to give the guitar some structure. As another example, U.S. Pat. No. 4,145,948 which issued to Turner for an invention entitled "Graphite Composite Neck for Stringed Musical Instruments" disclosed an instrument having a body made of wood and a dimensionally stable neck which is made of a graphite fiber reinforced plastic material. Yet another example is U.S. Pat. No. 4,951,542 which issued to Chen for an invention entitled "Electric Guitar Neck" and which discloses a neck with a wood core and a fiber reinforced plastic coating.

In the above examples, where wood is used, there is still susceptibility to warping and distortions which will adversely affect the tonality and stability of the neck. Where hollow structures are disclosed, the resonance of the instrument can be adversely affected. Further, where synthetic materials are used there may be some need for additional reinforcement rods which can adversely affect the weight and balance of the instrument.

In light of the above, it is an object of the present invention to provide a neck for a stringed instrument, and its method of manufacture, which provide for improved stability and, therefore, requires less tuning. Another object of the present invention is to provide a neck for a stringed instrument, and its method of manufacture, which is less susceptible to external factors such as temperature and humidity. Still another object of the present invention is to provide a neck for a stringed instrument which does not rely on the acquisition of difficult to obtain hardwoods. Yet another object of the present invention is to provide a neck for a stringed instrument which is capable of providing the strength, stability, resonance and weight and balance characteristics that are desirable for such a musical instrument. Another object of the present invention is to provide a neck for a stringed instrument that is relatively easy to manufacture, simple to use and comparatively cost effective.

SUMMARY OF THE PREFERRED EMBODIMENTS

A neck for a stringed musical instrument includes a molded foam core which is formed with a peghead. The foam core has a surface and there are layers of reinforcing material which are positioned over substantially all of the surface of the foam core. A surfacing material is bonded with a resin to the layers of reinforcing material and to the foam core. The surfacing material thus establishes an external surface for the neck.

The musical instrument, itself, basically includes the neck and a body. The neck further includes inserts which are positioned in hollows that are formed into the foam core. For the present invention these inserts are intended to reinforce the foam core at points where the neck is engaged with the body of the musical instrument. The neck may also be formed with a hollow for receiving a truss rod assembly therein. If used, the truss rod assembly is then adjustable to move the peghead relative to the body of the musical instrument to facilitate and maintain the tuning of the musical instrument.

As intended for the present invention, the surfacing material which is used for the external surface of the neck is either formed with a fretboard or is formed to receive a fretboard which can be mounted on the external surface. For the present invention, the foam core is preferably made of a 2-part urethane foam, and the reinforcing layer(s) is selected from a group including dry glass and carbon. The surfacing material is selected from a group including epoxy based and polyurethane based materials, and the resin which binds the surfacing material to the reinforcing layer(s) and the foam core is selected from a group including epoxy, phenolic, polyester and vinyl ester.

In accordance with the present invention, the manufacture of a neck for a stringed instrument requires molding a foam core having a surface. At least one layer of a reinforcing material is then positioned over substantially the entire surface of the foam core to create a preform assembly. Next, a surfacing material may be used to establish an external surface for the neck. If used, the shaped surfacing material is then bonded with a resin to the layer of reinforcing material and to the surface of the foam core to create an integrally unified structure for the neck. More specifically the shaping of the surfacing material requires applying the surfacing material to the opposed surfaces of a two-part cavity mold. The surfacing material is then cured to establish a shape for the external surface of the neck. Next, regardless whether a surfacing material is used, the preform assembly is placed in the cavity of the mold and the mold is closed. A vacuum is then drawn in the cavity of the mold and a resin is injected into the cavity of the mold to impregnate and wet out the reinforcing material. This will then bond the reinforcing material to the foam core and form an external surface for the neck. When a surfacing material has been used to form the external surface, the resin will still impregnate and wet out the reinforcing material as it bonds the preform assembly to the surfacing material. In either case, all of this may be followed by pressurizing the neck in the cavity mold after the resin has been injected. After a suitable cure cycle, all that is then required is to trim flash from the neck, mount a fretboard on the neck (if necessary) and otherwise finish the external surface.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
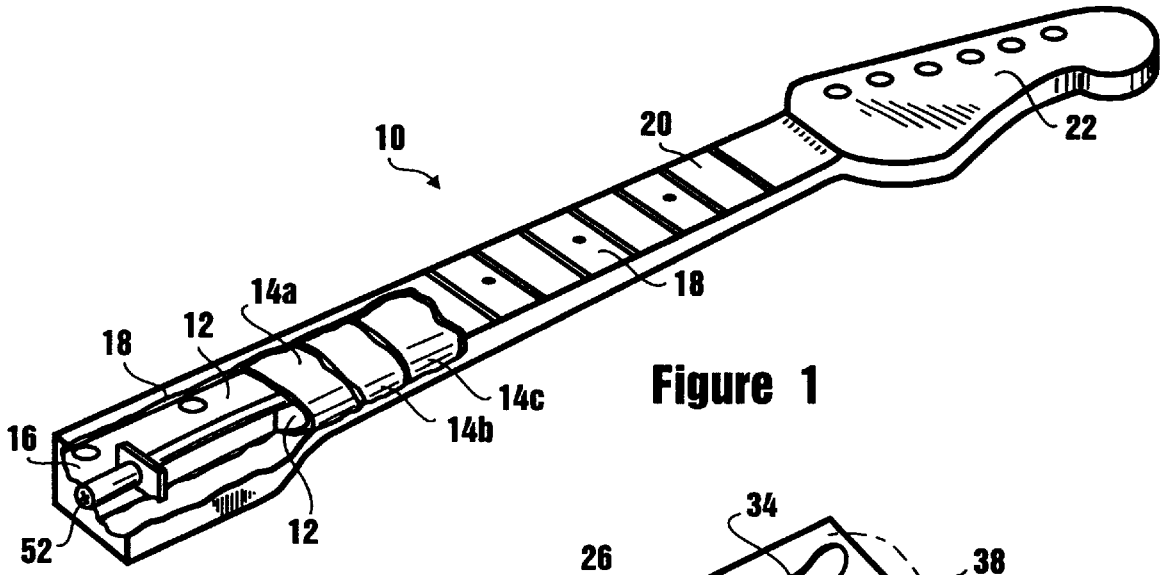
FIG. 1 is a perspective view of the neck for a musical instrument in accordance with the present invention with portions broken away for clarity.

Referring initially to FIG. 1, a neck for a stringed musical instrument is shown and generally designated 10. As shown, it will be seen that the neck 10 includes a molded foam core 12. For the present invention, this foam core 12 is preferably made of a two part urethane which is well known in the pertinent art. As is also well known in the art, differing types of foam can be used and different foam densities can be employed to achieve the particular weight and acoustic properties that are desired. Further, in accordance with the present invention, the foam core 12 is wrapped with layers 14 of reinforcing material, such as the layers 14*a–c* shown. Preferably, the reinforcing layers 14*a–c* will be fibers made of dry glass or carbon. In either case, the reinforcing layers 14*a–c* are wrapped so as to effectively cover the entire surface 16 of the foam core 12.

Integrally bonded over the reinforcing layers 14, and bonded to both the reinforcing layers 14 and the foam core 12, is a surfacing material which is provided to establish an external surface 18 for the neck 10. As shown in FIG. 1, a portion of this external surface 18 can be formed as a fretboard 20. For an alternate embodiment of the present invention, however, the fretboard 20 can be manufactured separately and later attached to the neck as shown. In either case, the surfacing material will completely cover the neck 10 which will include a pegboard 22 that is formed as part of the foam core 12.

Figure 2:
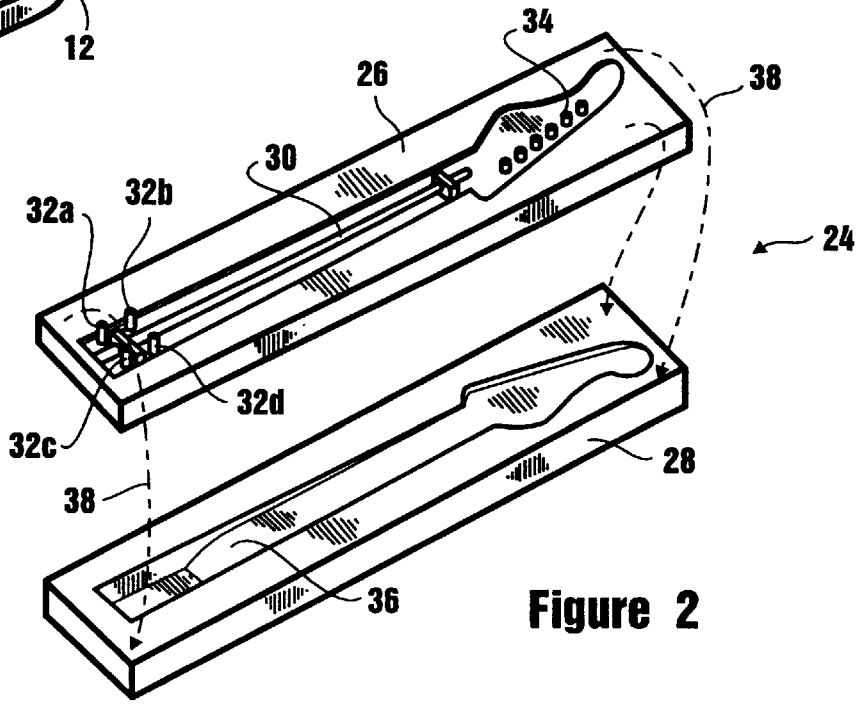
FIG. 2 is a perspective view of the two-part primary mold for creating the foam core for the neck of the present invention.

In FIG. 2, a primary two-part mold is shown and is generally designated 24. As shown here, this two-part mold 24 includes both an upper portion 26 and a lower portion 28. The upper portion 26, as well as the lower portion 28 of the mold 24 can be provided with whatever shapes and projections that are desired to determine the particular configuration for the article that is to be prepared by use of the mold 24. In the case of the neck 10 of the present invention, the upper portion 24 can include the elongated projection 30, the grouping of pin-like projections 32*a–d*, and the row of pegged projections 34 in the region of the peghead 22. With this particular configuration for the structure of the mold 24 it will be appreciated that when a foam material is inserted into the cavity 36 of the lower portion 28, and the upper portion 26 is turned onto the lower portion 28 to close the mold 24, as indicated by the arrows 38, the result will be a foam core 12 as shown in FIG. 3.

Figure 3:
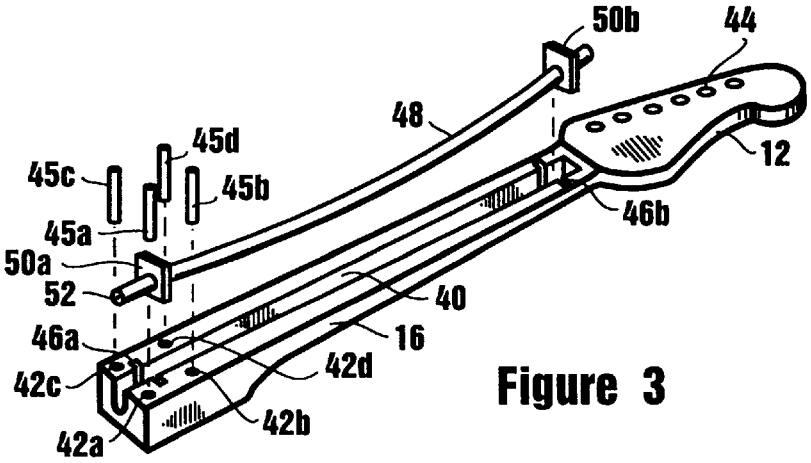
FIG. 3 is a perspective view of the foam core of the present invention shown with inserts in a exploded perspective.

In FIG. 3 it can be seen that the foam core 12 is formed with a hollow 40 that conforms with the projection 30 of the primary mold 24. Additionally, it is seen that the foam core 12 is formed with hollows 42*a–d* and hollows 44 which respectively conform to the projections 32*a–d* and 34 of the primary mold 24. As intended for the present invention, the inserts 45*a–d* can be received in the respective hollows 42*a–d* to provide reinforcements for fasteners (not shown) which will later be used to fixedly attach the neck 10 to the body of the musical instrument (not shown). FIG. 3 also indicates that the hollow 40 is formed with the indents 46*a* and 46*b*. Thus, the truss rod assembly 48 which includes the grips 50*a* and 50*b* can be received into the hollow 30. Specifically, the grip 50*a* is received into the indent 46*a* and the grip 50*b* is received into the indent 46*b*. It is to be noted in FIG. 3 that the truss rod assembly 48 is slightly bowed. Consequently, when the truss rod assembly 48 is inserted into the hollow 40, the screw head 52 of the truss rod assembly 48 can be rotated to reduce or increase the bowing of the assembly 48 between the grips 50*a* and 50*b*. In turn, this will change the dimensions of the truss rod assembly 48 and this change will then be transferred to the neck 10. As is well known to the skilled musician, this dimensional change can enhance the ability to tune the musical instrument and to subsequently maintain the tuning of the musical instrument.

Figure 4:
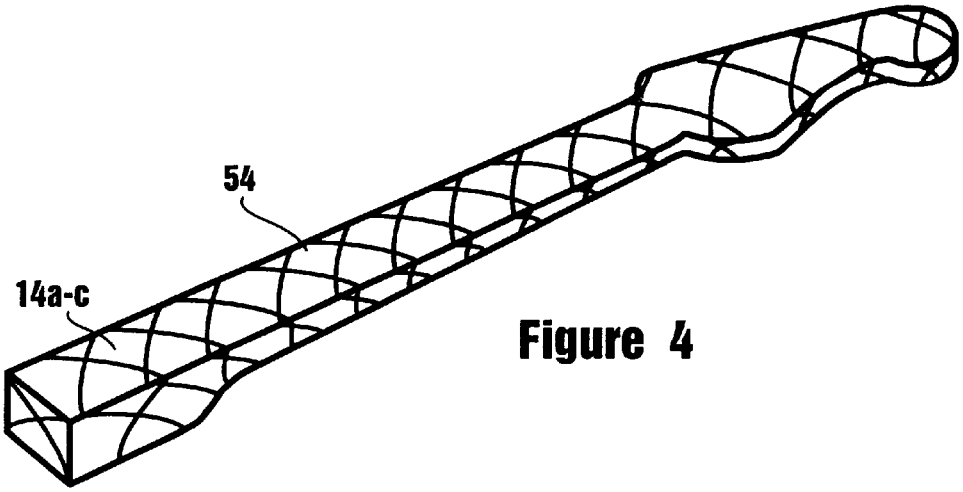
FIG. 4 is a perspective view of the preform assembly of the present invention.

FIG. 4 shows the preform assembly 54 which is prepared after the foam core 12 has been molded in the primary mold 24 and after the inserts 45*a–d* and the truss rod assembly 48, if used, has been placed in their respective hollows 42*a–d* and hollow 40. More specifically, FIG. 4 shows that the reinforcing material 14 has been placed to cover the foam core 12. Preferably, the reinforcing material 14 will be layers of dry glass or carbon or a combination of these layers. A braid or a "tied uniaxial" material is suitable for this purpose. It is to be appreciated that extra reinforcing material 14 may be positioned on the foam core 12, as desired. Thus, specially reinforced areas or locations, such as may be required around the truss rod assembly 48, can be created.

Figure 5:
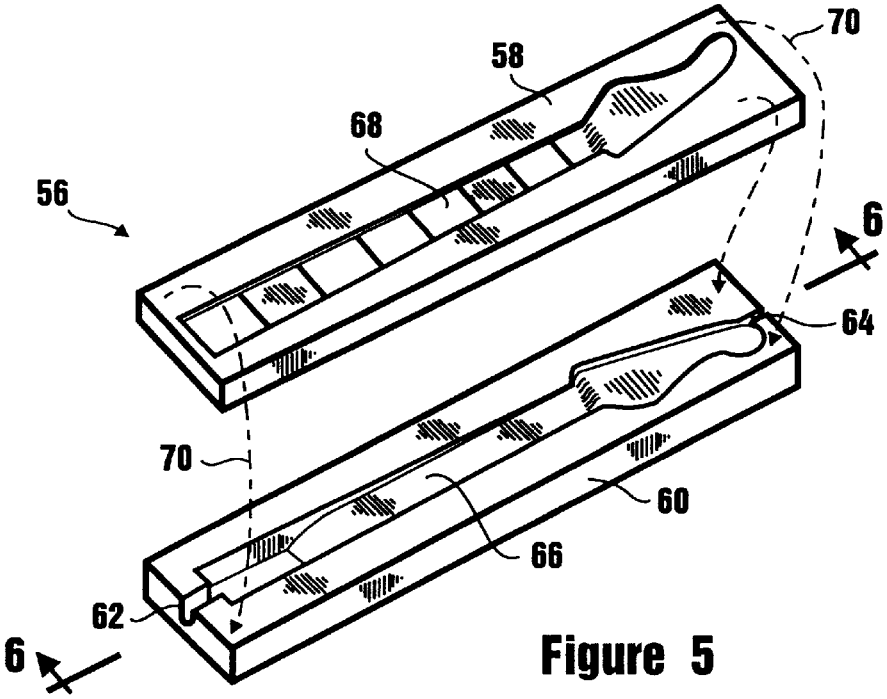
FIG. 5 is a perspective view of the two-part secondary mold for creating the neck of the present invention.
Figure 6:
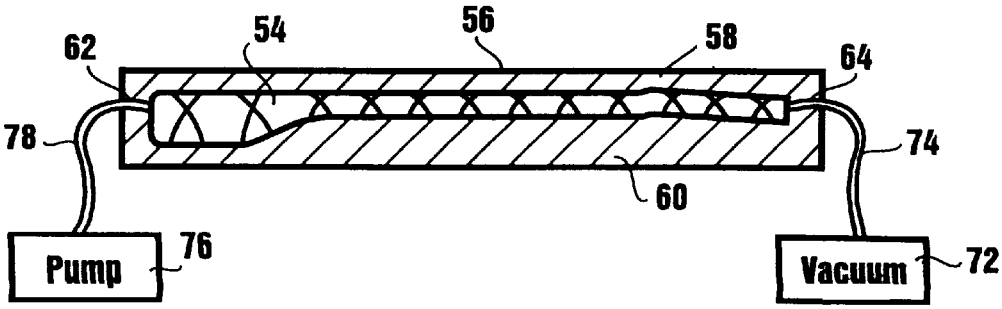
FIG. 6 is a cross sectional view of the secondary mold as seen along the line 6—6 in FIG. 5 when the preform assembly is positioned in the cavity of the secondary mold and the secondary mold is closed.

A secondary mold, generally designated 56 in FIG. 5, is used in the manufacture of neck 10 after the preform assembly 54 has been prepared. As shown in FIG. 5, the secondary mold 56 includes an upper portion 58 and a lower portion 60. The lower portion 60 is shown formed with an access port 62 at one end of the mold 56 and another access port 64 at the opposite end. The cavity 66 of the lower portion 60 is shaped to conform to the lower part of neck 10 and the cavity 68 of the upper portion 58 is shaped to conform to the upper part of neck 10. Both the cavity 68 and the cavity 66 of secondary mold 56 are dimensioned so that when the upper portion 58 is closed over the lower portion 60, as indicated by the arrows 70, the preform assembly 54 can be held therein.

In an alternate embodiment of the present invention, the cavity 68 of upper portion 58 and the cavity 66 of lower portion 60 can be coated with a surfacing material. For the selection of a surfacing material that is suitable for the neck 10 of the present invention, several options are possible. For example, it is known that either an epoxy based material or a polyurethane material is suitable for this purpose. In either case, once the surfacing material has been placed over the surfaces of cavities 66, 68 and allowed to cure, if necessary, the dry preform assembly 54 is placed into the cavity 66 of lower portion 60 of secondary mold 56. The mold 56 is then closed by placing the upper portion 58 on top of the lower portion 60.

With the preform assembly inside the secondary mold 56, a vacuum source 72 is connected to the access port 64 via a line 74. A vacuum can then be pulled inside the cavities 66, 68 of the secondary mold 56. A pump 76, which is connected to the access port 62 of secondary mold 56 via a line 78, can then be activated to inject a bonding material, such as a resin, into the secondary mold 56. As intended for the present invention, an epoxy resin is preferably used for the bonding material but other materials such as phenolic polyester or vinyl ester are also appropriate.

Recall, in one embodiment of the present invention the surfaces of cavities 66, 68 in secondary mold 56 were previously covered with a surfacing material. Consequently, when the resin is injected into the secondary mold 56 it will flow between the surfacing material and the preform assembly 54. Thus, it will contact the surfacing material as well as wet the reinforcing fibers of the preform assembly 54. The result is that the bonding material will bind the surfacing material to the reinforcing fibers 14, and to the foam core 12 of the preform assembly 54 to create an integrally unified structure for the neck 10. If a surfacing material is not used, the resin will, in addition to wetting the reinforcing layer 14, form the external surface 18 for the neck 10. In either case, once the injection of bonding material into the secondary mold 56 has been completed, the vacuum is released and, if desired, the mold 56 can be pressurized. The newly formed neck 10 can then be cured at ambient or elevated temperatures.

After the bonding material (resin) has been cured in the secondary mold 56, the neck 10 is removed from the mold 56 and trimmed of flash. Additionally, finishing operations are completed such as fret slot cutting, bonding of fretboard (if required) and trimming of frets.

While the particular Neck for Stringed Instrument as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A neck for a stringed musical instrument having a body which comprises:

at least one insert;

a molded foam core having a surface, said foam core formed with a peghead, and said foam core formed with a hollow for receiving said insert therein for engagement of said neck with said body to fixedly attach said foam core to said body;

at least one layer of a reinforcing material positioned over substantially all of said surface of said foam core;

a bonding material for adhering said layer of reinforcing material to said foam core; and a surfacing material for establishing an external surface for said neck.

2. A neck as recited in claim 1 further comprising a truss rod assembly and wherein said foam core is formed with a hollow for receiving said truss rod assembly therein, said truss rod assembly being adjustable to move said peghead relative to said body to facilitate and maintain tuning of said musical instrument.

3. A neck as recited in claim 1 wherein said surfacing material is formed with a fretboard.

4. A neck as recited in claim 1 wherein said surfacing material is selected from a group consisting of epoxy based and polyurethane based materials.

5. A neck as recited in claim 1 further comprising a fretboard mounted on said external surface thereof.

6. A neck as recited in claim 1 further comprising at least one reinforcing ply selectively positioned over a portion of said layer of reinforcing material to provide additional reinforcement for said neck.

7. A neck as recited in claim 1 wherein said foam core is made of a 2-part urethane foam.

8. A neck as recited in claim 1 wherein said reinforcing layer is selected from a group consisting of dry glass and carbon.

9. A neck as recited in claim 1 wherein said bonding material is a resin and is selected from a group consisting of epoxy, phenolic, polyester and vinyl ester.

10. A method for manufacturing a neck for a stringed musical instrument which comprises the steps of:

molding a foam core having a surface;

positioning at least one layer of a reinforcing material over substantially all of the surface of the foam core;

bonding the layer of reinforcing material to the surface of the foam core to create an integrally unified structure for the neck;

applying a surfacing material to the opposed mold surfaces, said opposed mold surfaces creating the cavity of a two-part cavity mold; and curing the surfacing material on the opposed surfaces of the cavity mold to establish a shape for the external surface of the neck.

11. A method as recited in claim 10 wherein said molding step and said positioning step result in a preform assembly and said bonding step includes the steps of:

placing the preform assembly into the cavity of the mold;

closing the mold;

injecting a resin into the cavity of the mold.

12. A method as recited in claim 11 further comprising the step of pressurizing the neck after said injecting step.

13. A method as recited in claim 12 further comprising the steps of:

trimming flash from the neck;

mounting a fretboard on the neck; and finishing the external surface.

14. A neck for a stringed musical instrument having a body, said neck having an integrally unified structure and formed with a peghead, a first hollow and a second hollow, and wherein said neck comprises:

a molded foam core having a surface;

at least one layer of a reinforcing material positioned over substantially all of said surface of said foam core and bonded thereto;

a surfacing material shaped to establish an external surface for said neck, said surfacing material being bonded to said reinforcing material on said surface of said foam core;

a fastener positioned in said first hollow to protrude from said neck for engagement with said body to fixedly attach said neck to said body; and a truss rod assembly positioned in said second hollow, said truss rod assembly being adjustable to move said peghead relative to said body to facilitate and maintain tuning of said musical instrument.

15. A method for manufacturing a neck for a stringed musical instrument which comprises the steps of:

molding a foam core having a surface;

selectively forming said foam core with at least one hollow for receiving an insert therein;

positioning at least one layer of a reinforcing material over substantially all of the surface of the foam core; and bonding the layer of reinforcing material to the surface of the foam core to create an integrally unified structure for the neck.

16. A method as recited in claim 15 wherein the foam core is formed with a peghead, wherein the musical instrument includes a body, wherein a first insert is a fastener protruding from the neck for engagement with the body to fixedly attach the neck to the body, and wherein a second insert is a truss rod assembly with the truss rod assembly being adjustable to move the peghead relative to the body to facilitate and maintain tuning of the musical instrument.

* * * * *